US006443188B1

(12) United States Patent
Banba et al.

(10) Patent No.: US 6,443,188 B1
(45) Date of Patent: Sep. 3, 2002

(54) WEFT INSERTING CONTROL DEVICE FOR FLUID JET TYPE LOOM

(75) Inventors: Hideki Banba; Hiroyuki Kawara, both of Ishikawa (JP)

(73) Assignee: Tsudakoma Kogyo Kabushiki Kaisha, Ishikawa (JP)

( * ) Notice: Subject to any disclaimer, the term of this patent is extended or adjusted under 35 U.S.C. 154(b) by 0 days.

(21) Appl. No.: 09/934,294

(22) Filed: Aug. 21, 2001

(30) Foreign Application Priority Data

Sep. 1, 2000 (JP) ..... 2000-266174

(51) Int. Cl.[7] ..... D03D 47/28
(52) U.S. Cl. ..... 139/435.2
(58) Field of Search ..... 139/435.2

(56) References Cited

U.S. PATENT DOCUMENTS 4,830,063 A * 5/1989 Takegawa ..... 139/435
5,322,089 A * 6/1994 Yamada ..... 139/435.2

FOREIGN PATENT DOCUMENTS

JP 6-39735 B2 5/1994

* cited by examiner

*Primary Examiner*—Andy Falik
(74) *Attorney, Agent, or Firm*—Frishauf, Holtz, Goodman & Chick, P.C.

(57) ABSTRACT

A weft inserting control device for fluid jet type loom is provided, including a weft insertion detecting unit for detecting dispersion of the weft reaching angle in a predetermined control cycle; a first comparing unit for comparing a detection value of the weft reaching angle given by the weft insertion detecting unit with a reference value showing an allowable range of the dispersion; and a second comparing unit for comparing the detection value with a threshold value showing a threshold in controlling the dispersion. The weft inserting control device also includes a controlling unit for controlling the weft reaching angle on the basis of the detection value and a result of the comparison carried out by the first comparing unit. The controlling unit controls the weft reaching angle by reducing a predetermined amount of the detection value and by using the threshold value as the detection value, for example, when the second comparing unit reveals the detection value to be over the threshold value.

3 Claims, 3 Drawing Sheets

WEFT INSERTING CONTROL DEVICE FOR FLUID JET TYPE LOOM

BACKGROUND OF THE INVENTION

1. Field of the Invention

The present invention relates to a weft inserting control device for fluid jet type loom for controlling weft reaching timing with relation to a rotation phase of a main shaft of the loom in weft insertion in the fluid jet type loom.

2. Description of the Related Art

Hitherto, in order to converge a dispersion of weft insertion completed timing for a rotation phase of a main shaft of a loom (referred to as weft reaching angle, hereinafter) at a predetermined weft reaching angle, an average deviation, which is an average of difference between an actual reaching angle and an objective reaching angle of weft yarn, has been calculated for every predetermined number of weft insertion times (referred to as picking number, hereinafter). It is arranged that, when the average deviation passes over a predetermined allowable range, fluid jet pressure of a main nozzle or an auxiliary nozzle for weft-inserting be controlled so that the reaching angle would be within the allowable range.

There is also proposed a method for measuring weft inserting power for each weft insertion to accumulate a difference between the weft inserting power and a reference value, and then, controlling the pressure of fluid supplied to a weft inserting nozzle or the rotating number of the main shaft of a loom when the accumulated value passes over an allowable range, as disclosed in a bulletin of Japanese Patent Publication No.39735/1994.

In the case of the former related art described above, however, it is difficult to determine a certain picking number for calculating the average deviation. Excessively large picking number leads to bad response for a rapid change of a weft reaching angle in changing supplied weft where a sort of weft is changed, which sometimes causes a unit to be out of control and stopped. On the contrary, excessively small picking number for calculating the average deviation leads to oversensitive response of a controlling system for a temporary rapid change of the weft reaching time even when the weft reaching angle is almost stable within the reference value, so that the pressure of a weft inserting nozzle would be changed and the reaching angle would not be stable in a converging direction to the contrary, which sometimes causes large dispersion of the reaching angle.

In the case of the latter related art described above, the response for a rapid change of the weft reaching angle can be better in controlling than the former related art described above. It is also difficult, however, as well as the above to determine an allowable range of the accumulated value. Excessively wide allowable range leads to inferior response in controlling similarly to the above, while excessively narrow allowable range leads to oversensitive response also for insignificant deviation of the reaching angle, both of which cause a problem that the reaching angle of weft is not stable. Thus, there have been problems of response and stability in controlling, which are conflicting each other, remaining.

SUMMARY OF THE INVENTION

In view of the above-described problems of the related art, the invention has been made and is aimed to provide a weft inserting control device for fluid jet type loom in which pressure change would be made small even at a small controlling picking number in a simple structure so that the response in controlling weft insertion can be better as well as the stability can be improved.

Specifically, the invention is concerned with a weft inserting control device for fluid jet type loom provided with a weft insertion detecting unit for detecting dispersion of a weft reaching angle in a predetermined control cycle such as one or a plurality of picking numbers, for example; a first comparing unit such as a control device for comparing a detection value of the weft reaching angle given by the weft insertion detecting unit with a reference value showing an allowable range of the dispersion; and a second comparing unit for comparing the detection value with a threshold value showing a threshold in controlling the dispersion, the weft inserting control device comprising a controlling unit such as a control device for controlling the weft reaching angle on the basis of the detection value and a result of the comparison carried out by the first comparing unit. Further, the controlling unit controls the weft reaching angle by reducing a predetermined amount of the detection value and by using the threshold value as the detection value, for example, when the second comparing unit reveals the detection value to be over the threshold value.

The controlling unit for the weft reaching angle controls supplied fluid pressure of the weft inserting nozzle, the timing of weft insertion, the rotation number of a main shaft of a loom or such in accordance with fuzzy reasoning corresponding to the above detection value.

The weft inserting control by the controlling unit of the detection value may be carried out when the detection value becomes same as or more than the reference value for every weft insertion, for average deviation of a plurality of weft insertion, or for one or plural picking time(s) in a predetermined plurality of picking. The above control can also be carried out when the detection value passes over the reference value successively for a plurality of picking times.

DESCRIPTION OF THE PREFERRED EMBODIMENTS

Figure 1:
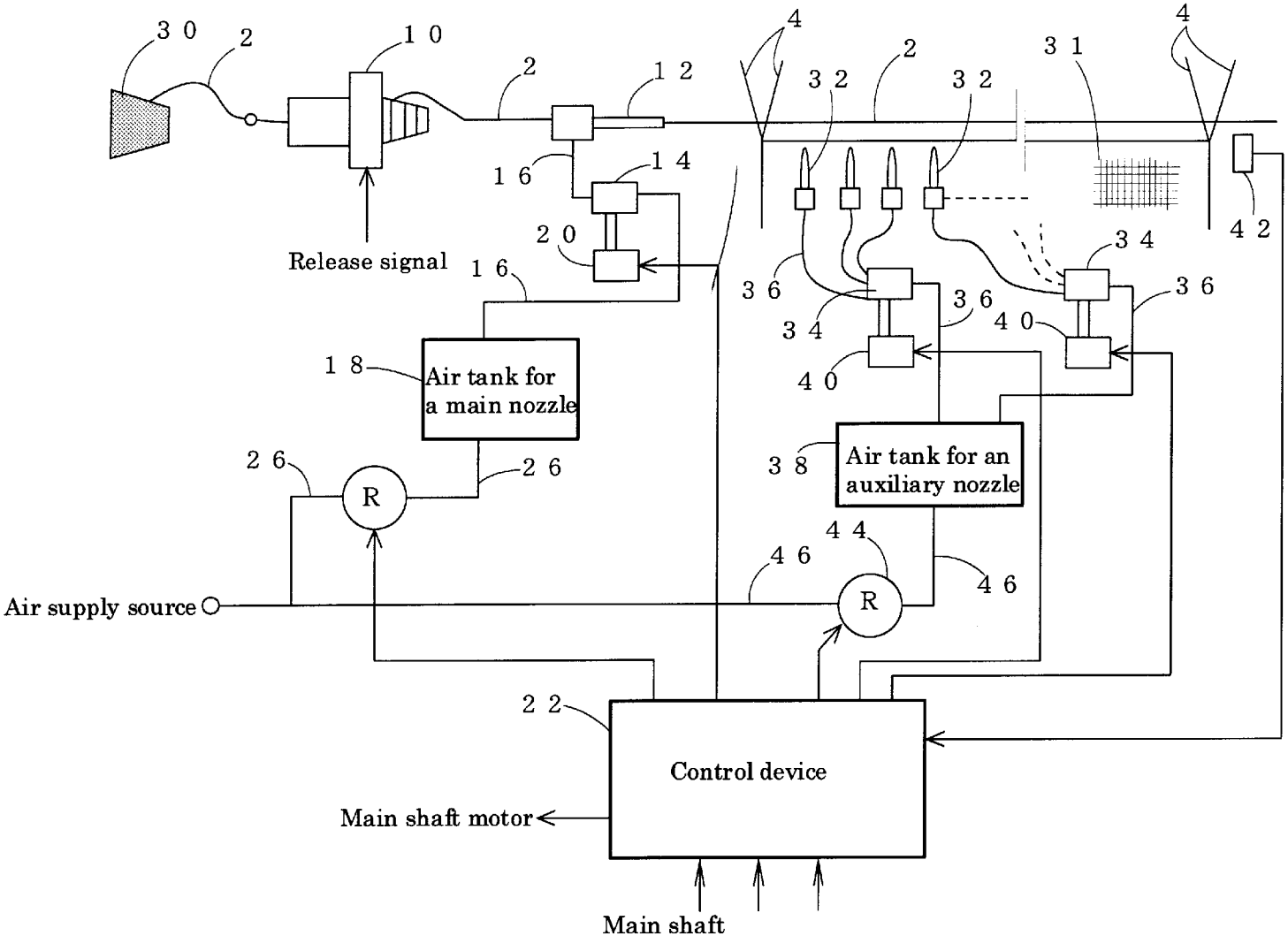
FIG. 1 is a schematic view of a weft inserting control device for fluid jet type loom according to the first embodiment of the invention.

An embodiment of the invention will be described hereinafter on the basis of the drawings. FIG. 1 is a weft inserting control device according to a first embodiment of the invention, which comprises a measuring and storing device 10 provided on a loom stand not shown in the drawings and a main nozzle 12, which is a weft inserting nozzle for transporting weft yarn 2 by means of air jet. The main nozzle 12 is connected with a tube path 16 provided in its middle part with a valve mechanism 14. A base end portion of the tube path 16 is connected to an air tank 18 for the main nozzle. The valve mechanism 14 is provided with an electromagnetic driving portion 20 such as a electromagnetic valve, which is connected to a control device 22 to be controlled. The air tank 18 for the main nozzle is connected to an air supplying source by a tube path 26 via an electropneumatic regulator 24, which is connected to the control device 22 to be controlled. The loom stand is also provided with a thread feeding body 30 for feeding the weft yarn 2 so that the weft yarn 2 fed from the thread feeding body 30 would be weft-inserted through the main nozzle 12.

A plurality of auxiliary nozzles 32, which are weft inserting nozzles, are positioned along a path for weft inserting the weft yarn 2 in the vicinity of a weaving front of a cloth 31, which has been weft-inserted. Each auxiliary nozzle 32 is connected with each tube path 36 provided in its middle part with a plurality of valve mechanisms 34, similar to the main nozzle 12. A base end portion of each tube path 36 is connected to an air tank 38 for the auxiliary nozzle. Each valve mechanism 34 is provided with an electromagnetic driving portion 40, each of which is connected to the control device 22 to be controlled. The air tank 38 for an auxiliary nozzle is connected to an air supplying source by a tube path 46 via an electropneumatic regulator 44, which is connected to the control device 22 to be controlled.

A weft detecting device 42, which is a weft insertion detecting unit, is provided on an anti-weft inserting side (on a side symmetrically contrary to the weft inserting nozzle with respect to the cloth) at the point preceding to the cloth 31 that the weft yarn 2 passes through. Output of the weft detecting device 42 is inputted to the control device 22. Further, such as rotary encoder not shown in the drawings detects and inputs to the control device 22 information such as rotation number and rotation phase of a main shaft of a loom not shown. Such information is converted into digital data and inputted to the control device 22 so as to be used for a predetermined calculation.

Next, an operation of the weft inserting control device for fluid jet type loom according to this embodiment will be described. First, when the loom is operated to carry out weft insertion, the weft yarn 2, which was fed from the thread supplying body 30 and stored in the measuring and storing device 10 for a predetermined period, is jetted from the main nozzle 12 together with jet fluid such as air so as to be weft-inserted in an opening of warp yarn 4. The weft-inserted weft yarn 2 is detected at its end by the weft detecting device 42 provided on the anti-weft insertion side, so that the weft insertion would be completed. In weft-inserting, each auxiliary nozzle 32 assists transportation of the weft yarn 2 so as to rapidly weft-insert the weft yarn 2 at a predetermined position. The air jet of the main nozzle 12 and the auxiliary nozzle 32 is carried out at timing corresponding to a predetermined rotation phase of the main shaft of a loom by opening and closing the air jet control valve not shown of the valve mechanisms 14 and 34 in accordance with a signal from the control device 22 into which information of a rotation angle of the main shaft of a loom has been inputted.

Figure 2:
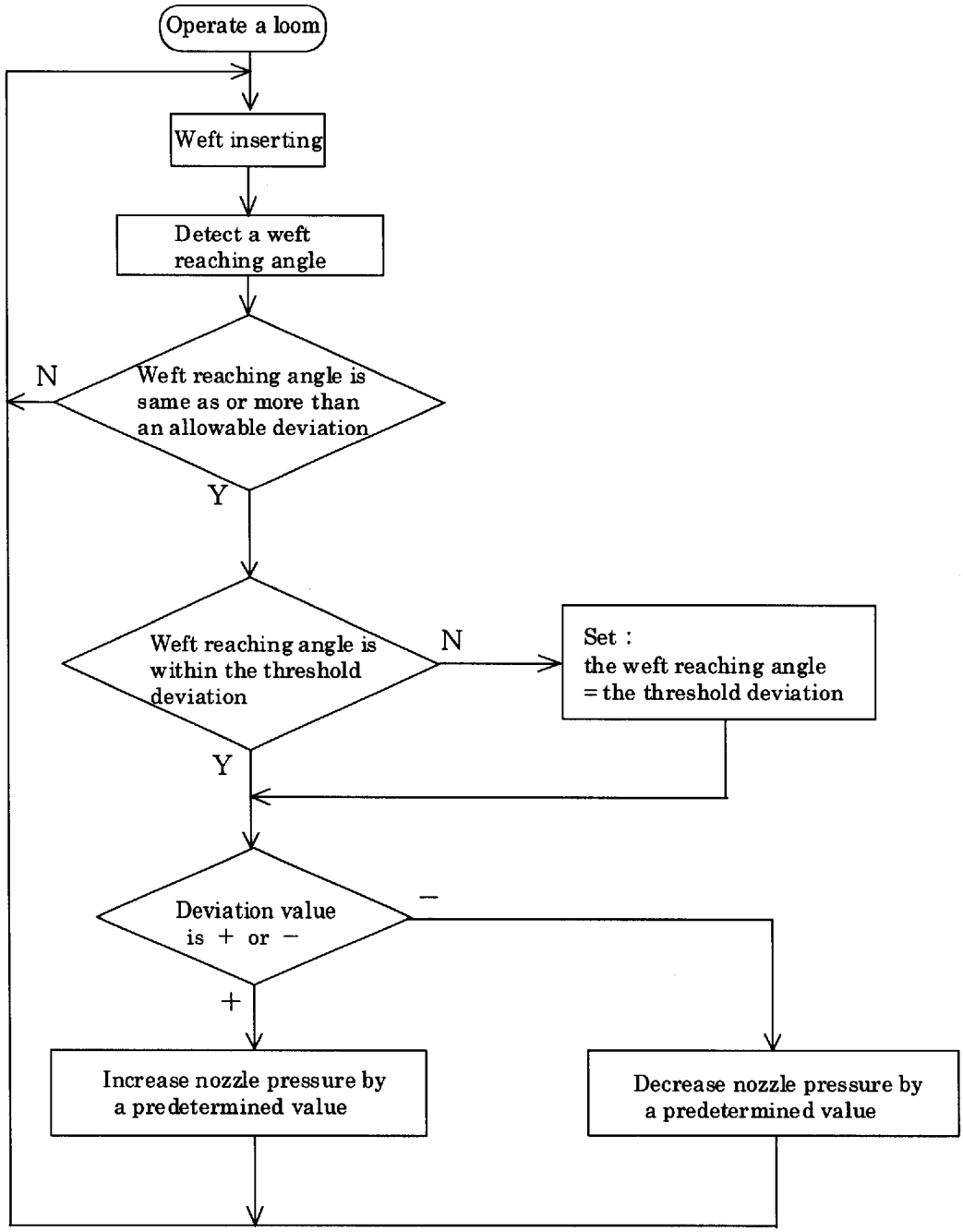
FIG. 2 is a flowchart showing a controlling method in the weft inserting control device according to the embodiment.
Figure 3:
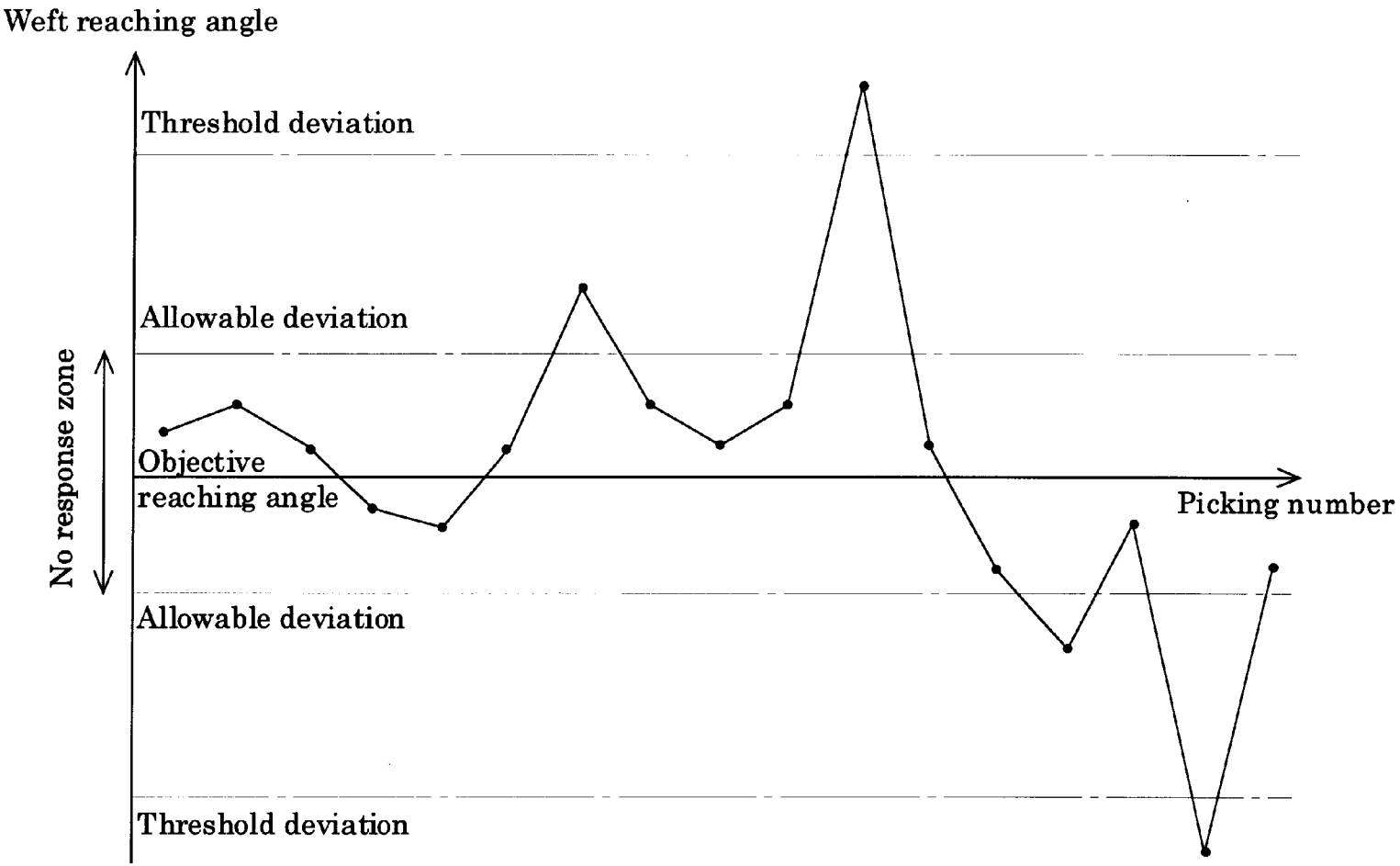
FIG. 3 is a graph showing a controlling method in the weft inserting control device according to the embodiment.

The weft reaching angle in weft insertion is controlled by such as a microcomputer in the control device 22. First, the control device 22 detects as a weft reaching angle a rotation phase of the main shaft of a loom at the time when the weft detecting device 42 detects an end of the weft yarn, as shown in FIG. 2. Then, the control device 22 judges whether or not the weft reaching angle, which is a detection value, is same as or more than the allowable deviation, which is a predetermined reference value. In the case that the weft reaching angle is within the allowable deviation, it means a no response zone in controlling, the control device 22 would not control the weft insertion such as pressure adjustment of the main nozzle 12, and the weft insertion would be carried out under such condition.

In the case that the weft reaching angle, which is the detection value, is same as or more than the allowable deviation, the control device 22 further judges whether or not the weft reaching angle is within a threshold deviation, which is a threshold value. Then, the weft inserting control is carried out as follows. In the case that the reaching angle is same as or more than the allowable deviation and within the threshold deviation, when the reaching angle is on the+side (on the delaying side in reaching) with respect to its objective reaching angle, the control device 22 controls electromagnetic driving portions 20 and 40 of the respective valve mechanisms 14 and 34 so that the air jet pressure of the main nozzle 12 and the auxiliary nozzle 32 would be increased by a predetermined value. On the contrary, when the reaching angle is on the−side (on the accelerating side in reaching) with respect to its objective reaching angle, the control device 22 controls electromagnetic driving portions 20 and 40 of the respective valve mechanisms 14 and 34 as well as the above so that the air jet pressure of the main nozzle 12 and the auxiliary nozzle 32 would be decreased by a predetermined value.

In the case that the weft reaching angle of the detection value is same as or more than the threshold deviation, the detection value is used as a set threshold deviation value so as to carry out weft inserting control in accordance with+ or−of the threshold deviation, similarly to the above.

The controlling amount of the weft reaching angle in controlling weft insertion is set in accordance with fuzzy reasoning on the basis of fluctuated amount of the air jet pressure of respective nozzles 12 and 32 so as to correspond to the detection value. As for other concrete control for the weft insertion, the timing for weft-inserting or the rotation number of the main shaft of a loom may be controlled.

In the above weft inserting control, when the deviation of the weft insertion reaching angle is same as or more than the allowable deviation and same as or less than the threshold deviation, the pressure of the main nozzle 12 and the auxiliary nozzle 32 is adjusted in accordance with the fuzzy reasoning on the basis of the amount of the above-mentioned deviation of the weft insertion reaching angle, while, when the deviation passes over the threshold deviation, the control device 22 adjusts the former deviation on the basis of the threshold deviation value, disregarding the deviation amount that passes over the threshold deviation. Then, the control device 22 oversensitively responds to temporary large disorder of the weft insertion reaching angle, which contrary causes less disorder of control, so that rapid and stable control would be possible.

The weft inserting control device for fluid jet type loom according to the invention is not limited to the above embodiment. It is possible to carry out the above-mentioned weft inserting control on the basis of an average of every plural picking numbers in controlling weft insertion. The sort and period of a control cycle such as picking number are set at any time properly. The controlling amount can be also set at any time properly on the basis of the deviation value other than the fuzzy reasoning.

The weft inserting control in the case that the threshold deviation is passed over may be such that the detection value passing over the threshold deviation is multiplied by a predetermined coefficient or function so as to make the value of its reaching angle small, and that the value made small is used as a detection value to carry out predetermined pressure control as well as the above.

Besides, proper controlling methods can be combined such that, for example, the control according to the above embodiment is performed when the allowable deviation is passed over successively for plural picking times, or such that the weft inserting control described above is performed when the allowable deviation of one or a plurality of picking among a predetermined plurality of picking is passed over.

The weft inserting control device for fluid jet type loom according to the invention can accurately and certainly correspond to a rapid change as well as a minor change in the weft reaching angle with a good response, so that stable control can be performed. Furthermore, any unexpected change in the reaching angle does not significantly influence the control device, so that it would be possible to achieve the stable control.

What is claimed is:

1. A weft inserting control device for a fluid jet type loom comprising:

a weft insertion detecting unit for detecting dispersion of a weft reaching angle;

a controlling unit for comparing a detection value given by the weft insertion detecting unit with a predetermined reference value, and for comparing the detection value with a control threshold value which is over the predetermined reference value;

wherein the controlling unit includes means for controlling the weft reaching angle when the detection value is determined to be over the threshold value, by making the detection value to be within the threshold value.

2. The weft inserting control device according to claim 1, wherein the controlling unit includes means for controlling the weft reaching angle by using the threshold value as the detectio[008e] value, when the detection value is determined to be over the threshold value.

3. The weft inserting control device according to claim 2, wherein the controlling unit includes means for calculating a controlling amount for weft insertion in accordance with fuzzy reasoning in response to a deviation amount of the weft inserting reaching angle so as to carry out the weft insertion.

* * * * *